US010774594B2

(12) United States Patent
Zhang et al.

(10) Patent No.: US 10,774,594 B2
(45) Date of Patent: Sep. 15, 2020

(54) ROTATING CUTTING STRUCTURES AND STRUCTURES FOR RETAINING THE SAME

(71) Applicant: Smith International, Inc., Houston, TX (US)

(72) Inventors: Youhe Zhang, Spring, TX (US); Chen Chen, New Haven, CT (US); Yuri Y. Burhan, Spring, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 0 days.

(21) Appl. No.: 15/763,345

(22) PCT Filed: Aug. 29, 2016

(86) PCT No.: PCT/US2016/049170

§ 371 (c)(1),
(2) Date: Mar. 26, 2018

(87) PCT Pub. No.: WO2017/058430

PCT Pub. Date: Apr. 6, 2017

(65) Prior Publication Data

US 2018/0274302 A1 Sep. 27, 2018

Related U.S. Application Data

(60) Provisional application No. 62/234,560, filed on Sep. 29, 2015.

(51) Int. Cl.

| | |
|---|---|
| ***E21B 10/42*** | (2006.01) |
| ***E21B 10/55*** | (2006.01) |
| ***E21B 10/567*** | (2006.01) |
| ***E21B 10/62*** | (2006.01) |

(52) U.S. Cl.
CPC ..... *E21B 10/42* (2013.01); *E21B 10/567* (2013.01); *E21B 10/5673* (2013.01)

(58) Field of Classification Search
CPC .... E21B 10/42; E21B 10/43; E21B 2010/545; E21B 10/55; E21B 2010/561; E21B 10/567; E21B 10/62
See application file for complete search history.

(56) References Cited

U.S. PATENT DOCUMENTS

| | | | | |
|---|---|---|---|---|
| 4,104,344 A | | 8/1978 | Pope et al. | |
| 4,222,446 A | | 9/1980 | Vasek | |
| 4,288,248 A | | 9/1981 | Bovenkerk et al. | |
| 4,505,058 A | | 3/1985 | Peterson | |
| 4,511,006 A | * | 4/1985 | Grainger ..... | B21K 25/00 175/354 |

(Continued)

FOREIGN PATENT DOCUMENTS

WO WO2013085869 A1 6/2013

OTHER PUBLICATIONS

First Office Action and Search Report issued in Chinese patent application 201680056964.5 dated Feb. 20, 2019, 18 pages.

(Continued)

*Primary Examiner* — Cathleen R Hutchins

(57) ABSTRACT

A downhole cutting tool includes a tool body defining a cutter pocket and a rolling cutter having an inner rotatable cutting element and a sleeve in the cutter pocket, where axial movement of the inner rotatable cutting element is limited by an external retention element disposed outside of the sleeve.

17 Claims, 13 Drawing Sheets

(56) References Cited

U.S. PATENT DOCUMENTS

| | | | | |
|---|---|---|---|---|
| 4,553,615 | A * | 11/1985 | Grainger | E21B 10/12 175/432 |
| 4,751,972 | A * | 6/1988 | Jones | E21B 10/50 175/336 |
| 5,127,923 | A | 7/1992 | Bunting et al. | |
| 5,678,645 | A | 10/1997 | Tibbitts et al. | |
| 5,906,245 | A | 5/1999 | Tibbitts et al. | |
| 6,070,945 | A | 6/2000 | Ritchey et al. | |
| 7,703,559 | B2 | 4/2010 | Shen et al. | |
| 7,762,359 | B1 | 7/2010 | Miess | |
| 8,091,655 | B2 | 1/2012 | Shen et al. | |
| 9,187,962 | B2 | 11/2015 | Burhan et al. | |
| 9,291,000 | B2 | 3/2016 | Zhang et al. | |
| 9,322,219 | B2 | 4/2016 | Burhan et al. | |
| 9,605,486 | B2 | 3/2017 | Burhan et al. | |
| 9,624,731 | B2 | 4/2017 | Haugvaldstad et al. | |
| 9,739,097 | B2 | 8/2017 | Zhang et al. | |
| 2008/0251293 | A1 | 10/2008 | Mumma et al. | |
| 2009/0020339 | A1 | 1/2009 | Sherwood, Jr. | |
| 2009/0158898 | A1 | 6/2009 | Sherwood, Jr. et al. | |
| 2010/0108403 | A1 | 5/2010 | Keshavan | |
| 2011/0284293 | A1 | 11/2011 | Shen et al. | |
| 2011/0297454 | A1 | 12/2011 | Shen et al. | |
| 2012/0073881 | A1 | 3/2012 | Shen et al. | |
| 2012/0132471 | A1 | 5/2012 | Zhang et al. | |
| 2012/0273281 | A1 | 11/2012 | Burhan et al. | |
| 2013/0333953 | A1 | 12/2013 | Zhang et al. | |
| 2014/0054094 | A1 | 2/2014 | Burhan et al. | |
| 2015/0069816 | A1 | 3/2015 | Fader et al. | |

OTHER PUBLICATIONS

International Search Report and Written Opinion issued in International Patent Application No. PCT/US2016/049170, dated Dec. 26, 2016, 18 pages.

International Preliminary Report on Patentability issued in International Patent Application No. PCT/US2016/049170, dated Apr. 12, 2018, 15 pages.

Second Office Action issued in Chinese patent application 201680056964.5 dated Sep. 27, 2019, 16 pages.

Third Office Action issued in Chinese patent application 201680056964.5 dated May 13, 2020, 10 pages.

* cited by examiner

ROTATING CUTTING STRUCTURES AND STRUCTURES FOR RETAINING THE SAME

CROSS REFERENCE TO RELATED APPLICATIONS

This application is the U.S. national stage entry of International Patent Application Serial No. PCT/US2016/049170 filed on Aug. 29, 2016, which application claims the benefit of U.S. Provisional Patent Application Ser. No. 62/234,560 filed on Sep. 29, 2015, the disclosure of which is incorporated by reference.

BACKGROUND

Various types and shapes of earth boring bits are used in various applications in the earth drilling industry. Earth boring bits have bit bodies which include various features such as a core, blades, and cutter pockets that extend into the bit body or roller cones mounted on a bit body, for example. Depending on the application/formation to be drilled, the appropriate type of drill bit may be selected based on the cutting action type for the bit and its appropriateness for use in the particular formation.

Drag bits, often referred to as "fixed cutter drill bits," include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (which may be made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are generally bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In some applications, a compact of polycrystalline diamond (PCD) (or other ultrahard material) is bonded to a substrate material, which may be a sintered metal-carbide to form a cutting structure. PCD includes a polycrystalline mass of diamonds (often synthetic) that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

A PDC cutter may be formed by placing a sintered carbide substrate into the container of a press. A mixture of diamond grains or diamond grains and catalyst binder is placed atop the substrate and treated under high pressure, high temperature conditions. In doing so, metal binder (often cobalt) migrates from the substrate and passes through the diamond grains to promote intergrowth between the diamond grains. As a result, the diamond grains become bonded to each other to form the diamond layer, and the diamond layer is in turn integrally bonded to the substrate. The substrate may be made of a metal-carbide composite material, such as tungsten carbide-cobalt. The deposited diamond layer is often referred to as the "diamond table" or "abrasive layer."

An example of PDC bit having a plurality of cutters with ultra hard working surfaces is shown in FIGS. 1 and 2. The drill bit 100 includes a bit body 110 having a threaded upper pin end 111 and a cutting end 115. The cutting end 115 includes a plurality of ribs or blades 120 arranged about the rotational axis L (also referred to as the longitudinal or central axis) of the drill bit and extending radially outward from the bit body 110. Cutting elements, or cutters, 150 are embedded in the blades 120 at angular orientations and radial locations relative to a working surface and with a back rake angle and side rake angle against a formation to be drilled.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore.

Referring to FIG. 2, a top view of a prior art PDC bit is shown. The cutting face 118 of the bit shown includes a plurality of blades 120, wherein each blade has a leading side 122 facing the direction of bit rotation, a trailing side 124 (opposite from the leading side), and a top side 126. Each blade includes a plurality of cutting elements or cutters generally disposed radially from the center of cutting face 118 to generally form rows. Certain cutters, although at differing axial positions, may occupy radial positions that are in similar radial position to other cutters on other blades.

Cutters may be attached to a drill bit or other downhole tool by a brazing process. In the brazing process, a braze material is positioned between the cutter and the cutter pocket. The material is melted and, upon subsequent solidification, bonds (attaches) the cutter in the cutter pocket. Selection of braze materials depends on their respective melting temperatures, to avoid excessive thermal exposure (and thermal damage) to the diamond layer prior to the bit (and cutter) even being used in a drilling operation. Specifically, alloys suitable for brazing cutting elements with diamond layers thereon have been limited to a couple of alloys which offer relatively low brazing temperatures to avoid or reduce damage to the diamond layer and high enough braze strength to retain cutting elements on drill bits.

A factor in determining the longevity of PDC cutters is the exposure of the cutter to heat. Polycrystalline diamond may be stable at temperatures of up to 700-750° C. in air, above which observed increases in temperature may result in damage to and structural failure of polycrystalline diamond. This deterioration in polycrystalline diamond may be due to the substantial difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

Exposure to heat (through brazing or through frictional heat generated from the contact of the cutter with the formation) can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond into graphite, causing rapid abrasive wear. As a cutting element contacts the formation, a wear flat develops and frictional heat is induced. As the cutting element continues to be used, the wear flat will increase in size and further induce frictional heat. The heat may build-up and cause failure of the cutting element due to thermal mis-match between diamond and catalyst discussed above. This is particularly true for cutters that are immovably attached to the drill bit, as conventional in the art.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole cutting tool that includes a tool body defining a cutter pocket and at least one rolling cutter including an inner rotatable cutting element and a sleeve. Axial movement of the inner rotatable cutting element is limited by an external retention element disposed outside of the sleeve.

In another aspect, embodiments disclosed herein relate to a downhole cutting tool that includes a tool body having at least one cutting element support structure formed thereon, the at least one cutting element support structure including at least one cutter pocket formed therein. At least one rolling cutter is in the at least one cutter pocket and includes an inner rotatable cutting element partially disposed in a circumferential sleeve. The inner rotatable cutting element has a back retention portion that extends axially beyond the circumferential sleeve, and the back retention portion has a groove formed therein with a retention element in the groove.

In another aspect, embodiments disclosed herein relate to a downhole cutting tool that includes a tool body having at least one cutting element support structure. The at least one cutting element support structure includes at least one cutter pocket in the at least one cutting element support and extending from an opening in a leading face and formation facing surface of the cutting element support to a back face. The at least one cutting element support structure also includes at least one retention opening in the formation facing surface spaced rearward from the opening of the at least one cutter pocket. The at least one retention opening extends into the cutting element support surface to interface the back of the cutter pocket. The tool further includes at least one rolling cutter in the at least one cutter pocket. The rolling cutter is at least partially retained by a retention element in the at least one retention opening.

In yet another aspect, embodiments disclosed herein relate to a downhole cutting tool that includes a tool body having at least one cutting element support structure. The at least one cutting element support structure includes at least one cutter pocket. At least one rolling cutter is in the at least one cutter pocket and includes an inner rotatable cutting element. The inner rotatable cutting element has an outermost diameter that extends at least 40% of an axial length of the rotatable cutting element. The rotatable cutting further includes a groove; and a retention element is in the groove, thereby retaining the rotatable cutting element in the cutter pocket.

Other aspects and advantages of the claimed subject matter will be apparent from the following description and the appended claims.

DETAILED DESCRIPTION

In some aspects, embodiments disclosed herein relate to drill bits and other downhole cutting tools using rotatable cutting structures (rolling cutters) and the retention of such rolling cutters.

Generally, rotatable cutting elements (also referred to as rolling cutters) described herein allow at least one surface or portion of the cutting element to rotate as the cutting element contacts a formation. As the cutting element contacts the formation, the cutting action may allow portion of the cutting element to rotate around a cutting element axis extending through the cutting element. Rotation of a portion of the cutting structure may allow for a cutting surface to cut the formation using the entire outer edge of the cutting surface, rather than the same section of the outer edge, as observed in a conventional cutting element.

Numerous variations on the cutting element capable of rotating may be used without departing from the scope of the present disclosure. For example, the rotation of the rolling cutter may be controlled by the side cutting force and the frictional force between the bearing surfaces. If the side cutting force generates a torque which can overcome the torque from the frictional force, the rotatable portion will have rotating motion. The side cutting force may be affected by cutter side rake, back rake, and geometry, including the working surface patterns disclosed herein. Additionally, the side cutting force may be affected by the surface finishing of the surfaces of the cutting element components, the frictional properties of the formation, as well as drilling parameters, such as depth of cut. The frictional force at the bearing surfaces may affected, for example, by surface finishing, mud intrusion, etc. The design of the rotatable cutters and the location and orientation of rotatable cutters on the bit disclosed herein may be selected to ensure that the side cutting force overcomes the frictional force to allow for rotation of the rotatable portion.

Figure 3:
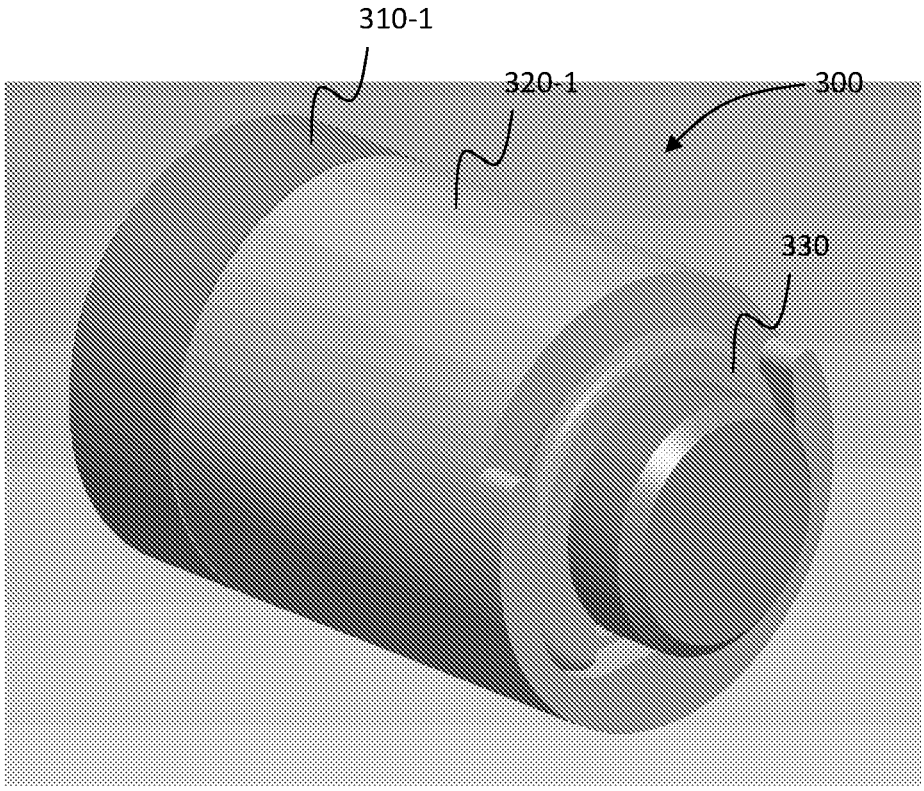
FIG. 3 shows a perspective view of a rolling cutter.
Figure 4:
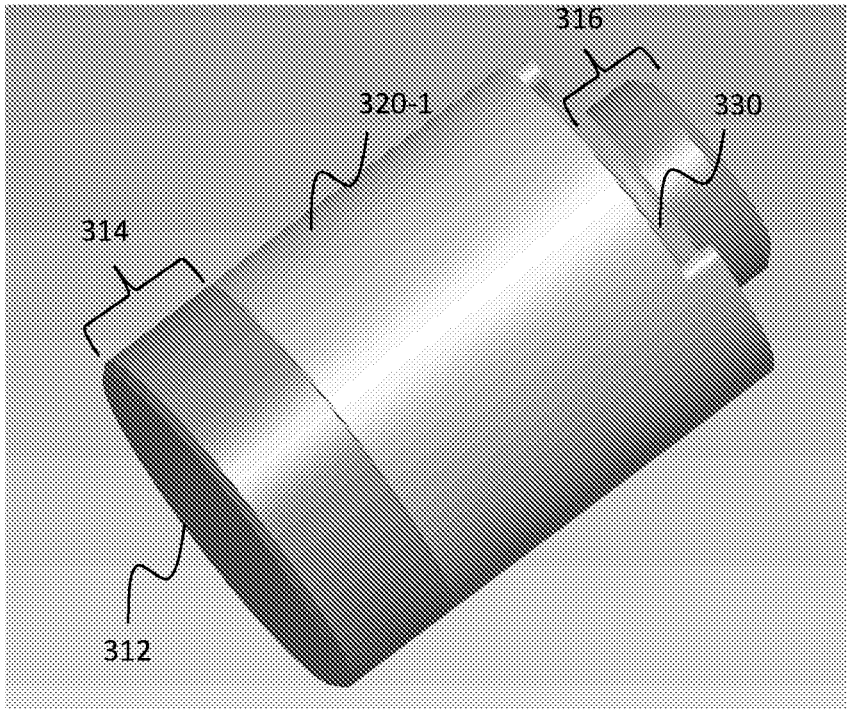
FIG. 4 shows a perspective view of a rolling cutter.
Figure 9:
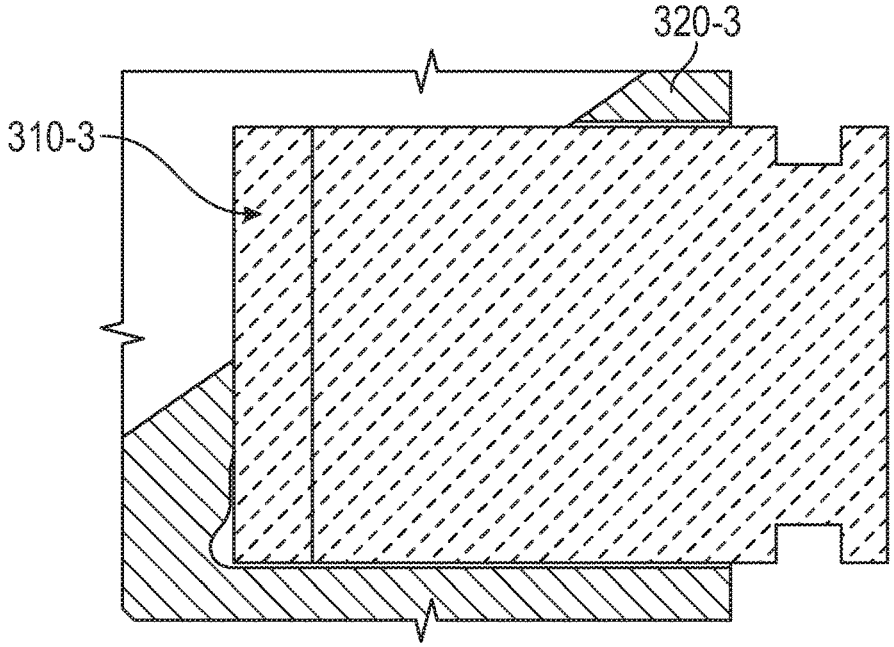
FIG. 9 shows a cross-sectional view of a sleeve and cutting element according to one embodiment of the present disclosure.

Referring now to FIG. 3 (a back perspective view) and FIG. 4 (a front perspective view), one embodiment of a rolling cutter is shown. Each rolling cutter 300 includes an inner rotatable cutting element 310-1 at least partially disposed in a sleeve 320-1. Inner rotatable cutting element 310-1 extends an axial distance from sleeve 320-1, terminating in a cutting surface 312 that interfaces the formation to be drilled. The cutting extension 314 portion of inner rotatable cutting element 310-1 may include an ultrahard material layer and optionally a substrate. As illustrated, the cutting extension portion 314 of inner rotatable cutting element 310-1 and sleeve 320-1 have substantially the same outer diameter. However, the present disclosure is not so limited, and the inner rotatable cutting element may instead have the same diameter along substantially the entire length of the element (except for grooves for retention) and the sleeve may have a larger diameter and envelop inner rotatable cutting element (except for a cut-away for exposure of the cutting surface along a portion of the circumference adjacent the cutting surface). Such a sleeve 320-3 and inner rotatable cutting element 310-3 combination is illustrated in FIG. 9.

Inner rotatable cutting element is retained within sleeve (with limitation on the axial movement thereof) by external retention element 330. External retention element 330 is disposed at an axially lower position (opposite cutting extension portion 314) of sleeve 320-1. Thus, a back retention portion 316 of inner rotatable cutting element 310-1 extends axially lower than sleeve 320 to limit the axial movement of inner rotatable cutting element 310-1 relative to sleeve 320-1. In limiting the axial movement, inner rotatable cutting elements 310-1 may be allowed to move axially back into the sleeve 320-1 based on general forces experienced during drilling when weight on bit is applied, but external retention element 330 may keep the inner rotatable cutting element 310-1 from falling out of the sleeve 320-1.

Figure 5:
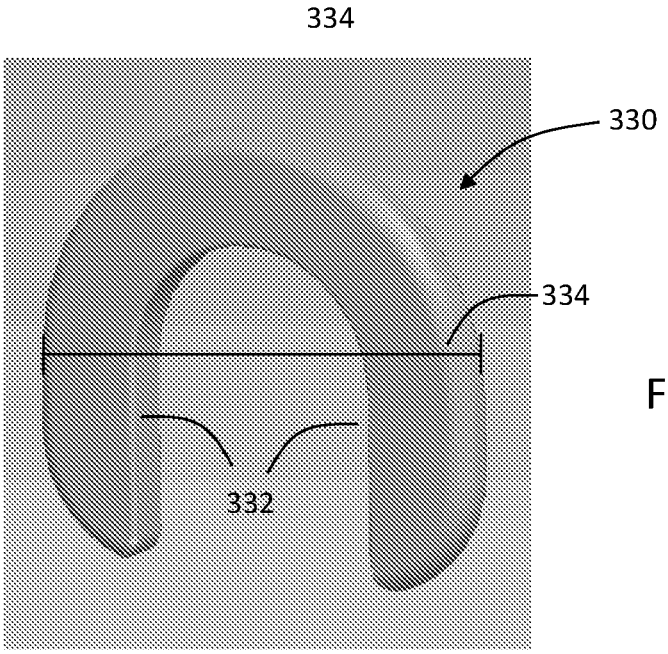
FIG. 5 shows a perspective view of a retention element for an embodiment of a rolling cutter.

Referring now to FIG. 5, a perspective view of one embodiment of an external retention element 330 is shown. As shown in FIG. 3, external retention element 330 is a clamp, such as a c-clamp, that may fit into a groove in an outer circumference of back retention portion 316 of inner rotatable cutting element 310-1. Retention element 330 includes two linear arms 332 extending from an arcuate connecting region 334; however, the present disclosure is not so limited, and the arms may be curved, and/or the connecting region may be substantially linear. In one embodiment, retention element 330 may retain inner rotatable cutting element 310-1 by the interfacing shapes, while other embodiments may also use compression on inner rotatable cutting element 310-1. The size of retention element 334 may vary, but in some embodiments may be less than the outer diameter of the sleeve 320-1, which may range, for example, from 11-22 mm. Other embodiments, where a greater strength may be desired, may use a retention element that is slightly larger than the sleeve (e.g., 334 may be larger than an outer diameter of the sleeve), such as 5 mm or less than the sleeve diameter.

Figure 1:
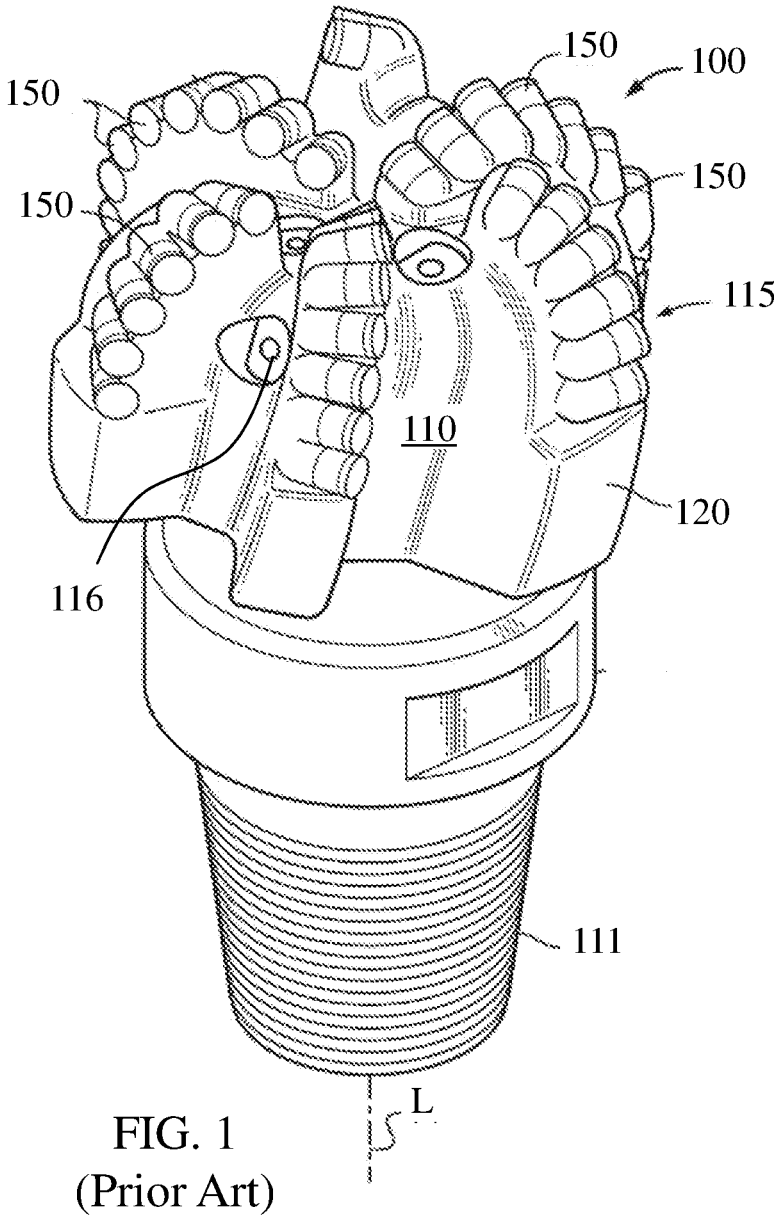
FIG. 1 (Prior Art)
FIG. 1 shows a perspective view of a conventional drag bit.
Figure 2:
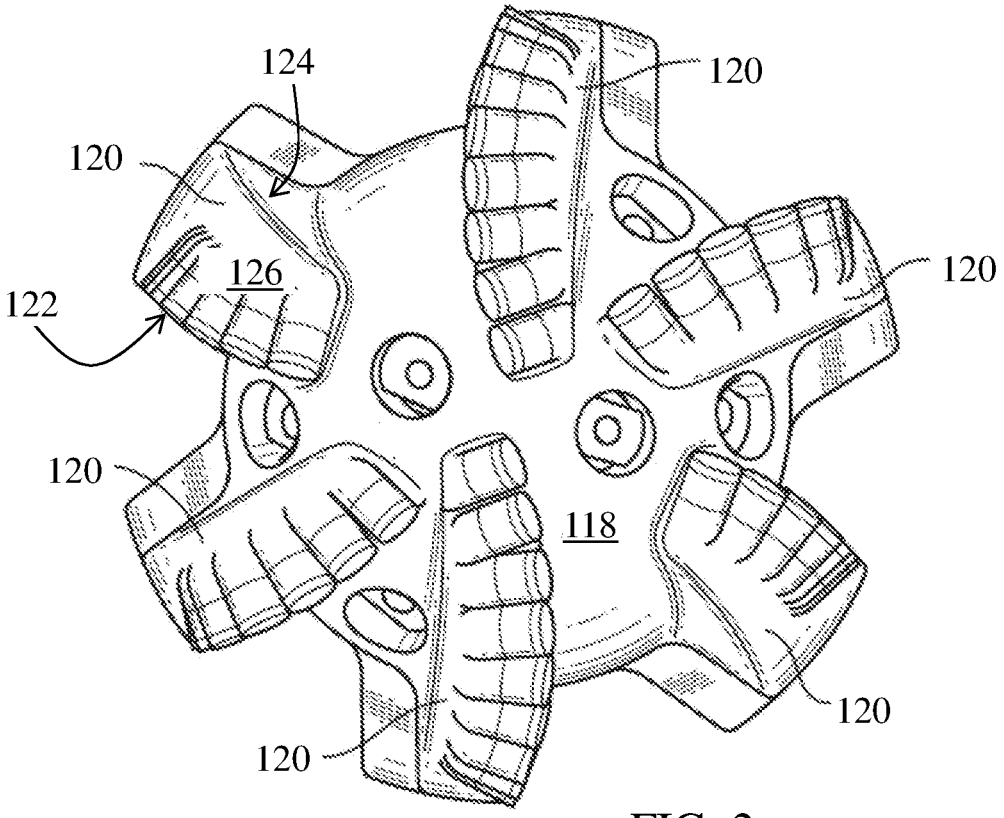
FIG. 2 (Prior Art)
FIG. 2 shows a top view of a conventional drag bit.
Figure 6:
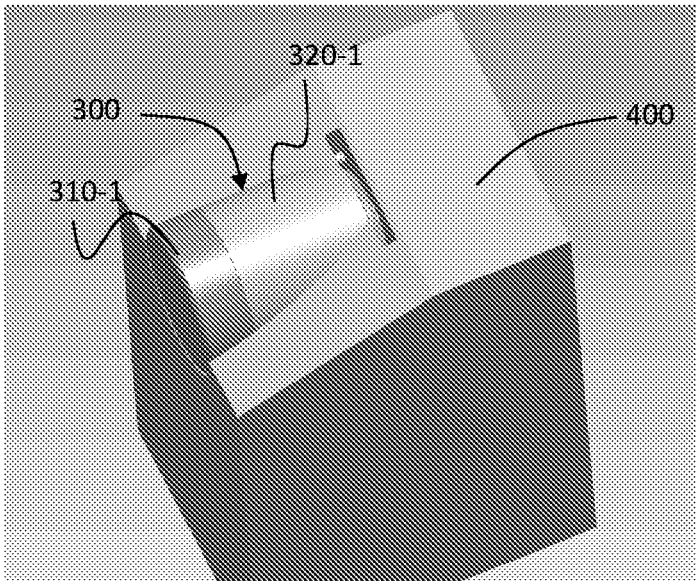
FIG. 6 shows a perspective view of a downhole cutting element support structure including a rolling cutter thereon.

Inner rotatable cutting element 310-1, once inserted into a sleeve 320-1, together referred to as a rolling cutter 300, may be disposed on a cutting element support structure 400, as illustrated in FIG. 6. Sleeve 320-1 may be attached to cutting element support structure 400 using techniques such as by brazing, infiltration, casting, etc., as well as using mechanical devices, such as screws, a sleeve with threads along an outer diameter, etc. In one or more embodiments, cutting element support structure 400 may be a drill bit (such as that shown in FIGS. 1 and 2) or other downhole cutting tool, e.g., a downhole tool that conventionally uses PDC cutters.

Figure 7:
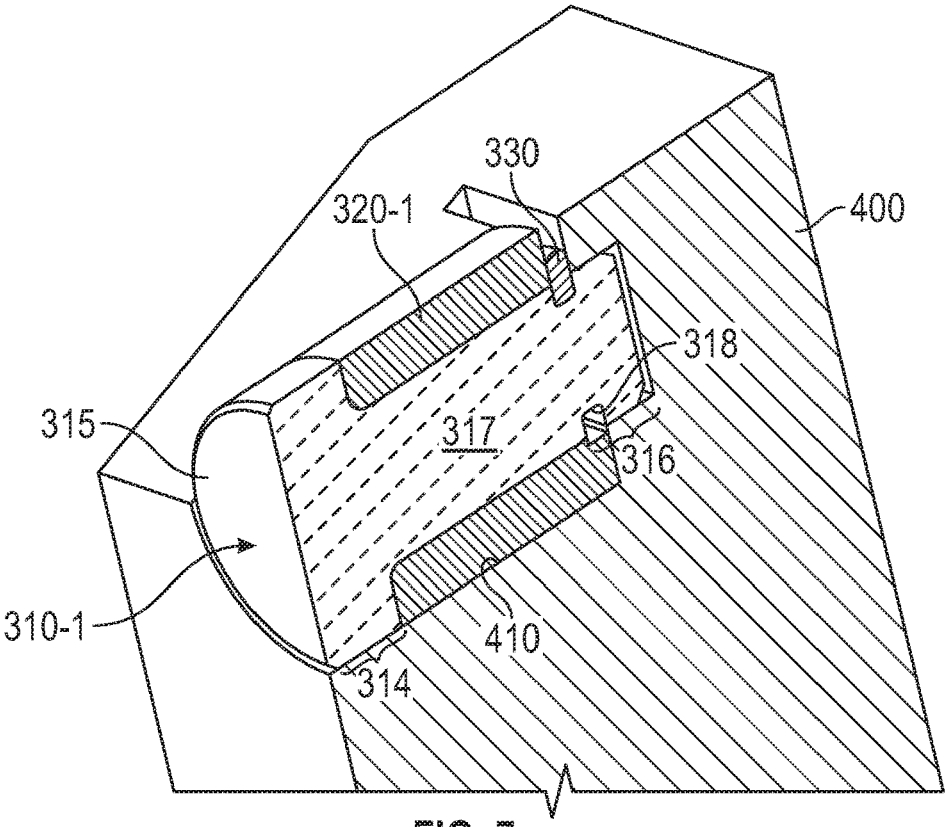
FIG. 7 shows a cross-sectional view of a downhole cutting element support structure including a rolling cutter thereon.

Referring now to FIG. 7, a cross-sectional view of a rolling cutter installed on a cutting element support structure, the rolling cutter includes an inner rotatable cutting element 310-1 partially disposed within sleeve 320-1. The inner rotatable cutting element 310-1 includes a cutting extension portion 314 and a back retention portion 316, each extending axially from sleeve 320-1 in opposite directions. Inner cutting element 310-1 is illustrated as including an ultrahard material layer 315 (forming part of cutting extension portion 314) and substrate 317 (forming part of back retention portion 316). A groove 318 is formed in the outer circumference of a portion of substrate 317 along the back retention portion 316. Outer retention element 330 is disposed within groove 318 to mechanically limit the axial movement of inner rotatable cutting element 310-1 (to the extent discussed above). Sleeve 320-1 may be retained within a cutter pocket 410 formed in cutting element support structure 400 as described herein. Pocket 410 extends axially longer than sleeve 320-1 to accommodate inner rotatable cutting element 310-1. In one or more embodiments, in addition to receiving the back retention portion 316 of inner rotatable cutting element 310-1, the cutting extension portion 314 may also be supported by cutter pocket 410, i.e., inner rotatable cutting element 310-1 does not extend substantially beyond a leading face 402 (in the direction of rotation of the tool) of the cutting element support structure 400 (such as a blade of a drill bit). If a portion of the inner rotatable cutting element extends beyond the leading face 402, such extension may be less than 0.200 inch, in one or more embodiments. In operation, in one or more embodiments, the sleeve 320-1 may be secured to the cutter pocket 410 prior to assembly with the inner rotatable cutting element 310-1, and upon installation of the inner rotatable cutting element 310-1 within the sleeve, outer retention element 330 may be inserted to fit within the groove 318, thereby retaining the inner rotatable cutting element 310-1 in such a manner that the element is free to rotate about its axis, but has limited axial and radial movement. Further, the outer retention element 330 may optionally remain accessible and exposed, thereby allowing for replacement of the inner rotatable cutting element 310-1. In one or more embodiments, the sleeve may overlap the external retention element (in that the sleeve has a larger inner diameter than the outer spread of the retention element) through an asymmetrical form at the bottom end thereof (as illustrated in FIG. 3-4) so long as the retention element is accessible and exposed.

Figure 8:
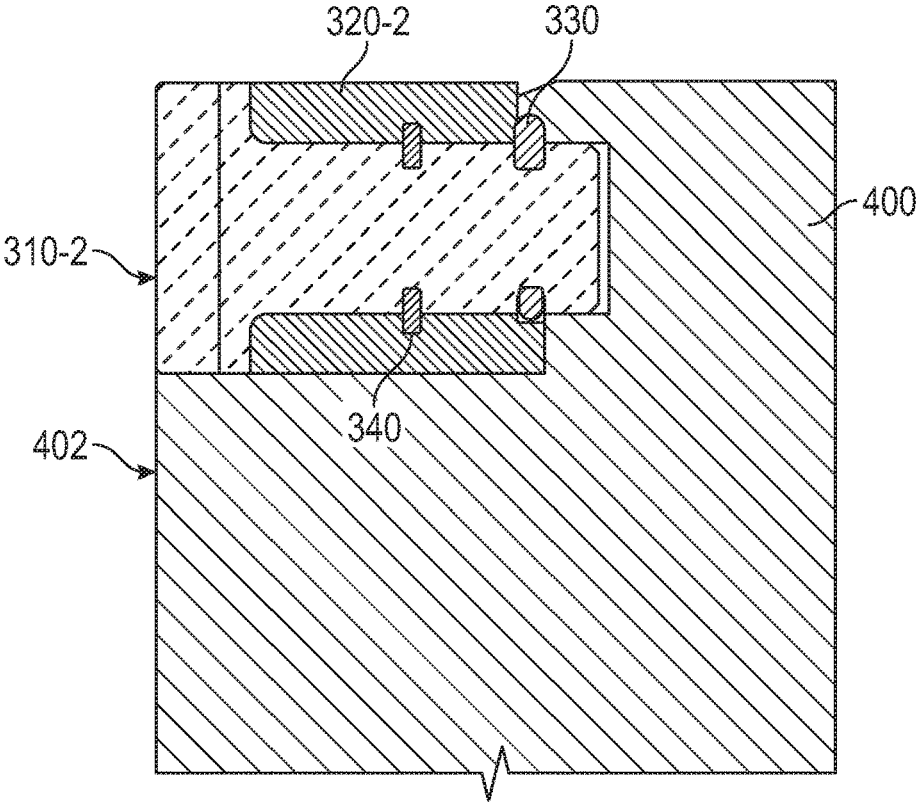
FIG. 8 shows a cross-sectional view of a downhole cutting element support structure including a rolling cutter thereon.

As shown in the cross sectional view of a rolling cutter installed on a cutting element support structure of FIG. 8 according to embodiments of the present disclosure, in addition to the outer retention element 330 that is external to the sleeve 320-2, the rolling cutter may also include an internal retention element 340 disposed in grooves formed in the inner rotatable cutting element 310-2 and sleeve 320-2 at an axial length that is entirely surrounded by sleeve 320 (i.e., it is entirely internal to the rolling cutter). Such internal retention elements may include, for example, retention rings, pins, balls, etc. In one or more particular embodiments, the internal retention element 340 may be a closed loop retention ring, such as the type discussed in U.S. patent application Ser. No. 61/794,580 and U.S. Ser. No. 13/972,465, which is assigned to the present assignee and herein incorporated by reference in its entirety.

Figure 10:
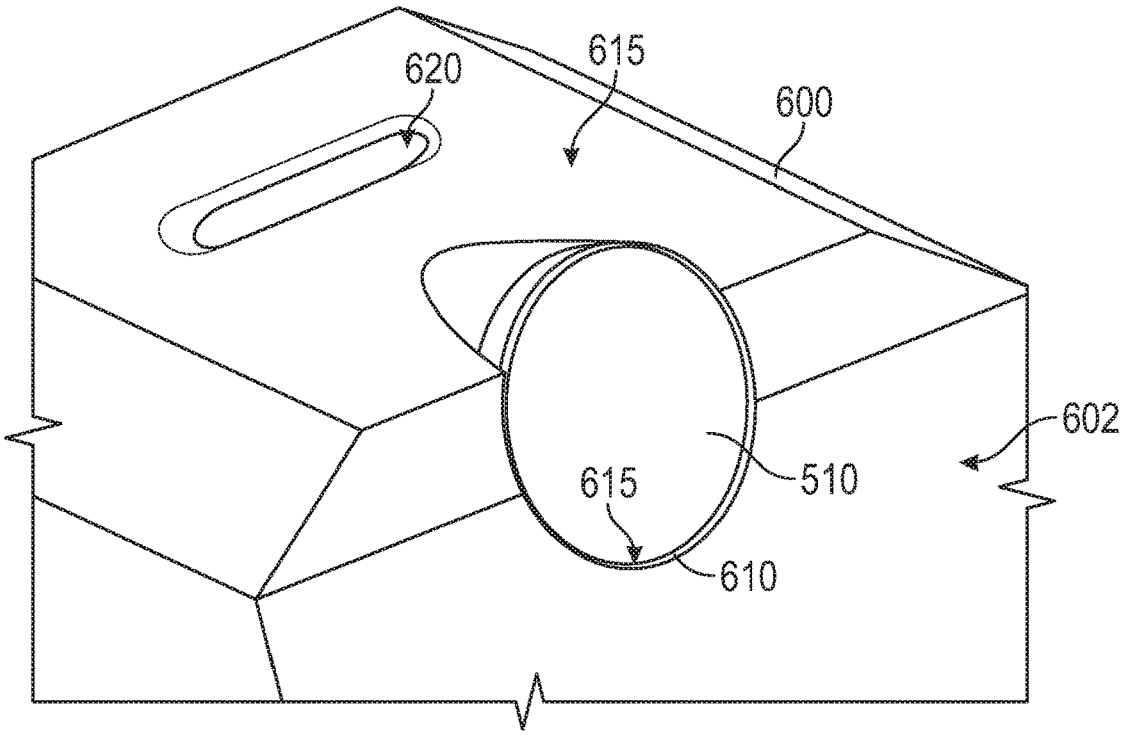
FIG. 10 shows a perspective view of a downhole cutting element support structure including a rolling cutter thereon.

Referring now to FIG. 10, another embodiment of a rotatable cutting element 510 is shown. As illustrated, a rotatable cutting element 510 is disposed in a cutter pocket 610 formed in a cutting element support structure 600. Cutter pocket 610 opens to the leading face 602 (in the direction of rotation of the cutting tool). In the illustrated embodiment, the back or retention end of inner rotatable cutting element 510 is enveloped by cutter pocket 610. A retention opening 620 may be formed in the formation-facing surface 615 (top surface that faces the formation when the cutting tool is oriented in a wellbore) spaced rearward of the opening of cutter pocket 610 to the leading face 602. In particular embodiments, such as the one illustrated, cutter pocket 610 may be open (having an arc length of less than 360 degrees) for a first distance rearward of the leading face 602. Retention opening 620 is located a second distance rearward from the point at which the cutter pocket transitions to being closed (extending the entire 360 degrees around the inner rotatable cutting element 510). Retention opening 620 extends axially inward into the cutting element support structure 600 to intersect the cutter pocket 610 near or adjacent (relative to the cutting pocket opening) to a back face of the cutter pocket 610. While not shown in this illustration, a retention element may be disposed in the retention opening to also intersect cutter pocket 610, and to interface an inner rotatable cutting element 510, thereby retaining inner rotatable cutting element 510 in cutter pocket 610. Rotatable cutting element 510 may be assembled with a sleeve, similar to those embodiments discussed above, or rotatable cutting element may be retained by a retention element directly without the use of a sleeve.

Figure 11:
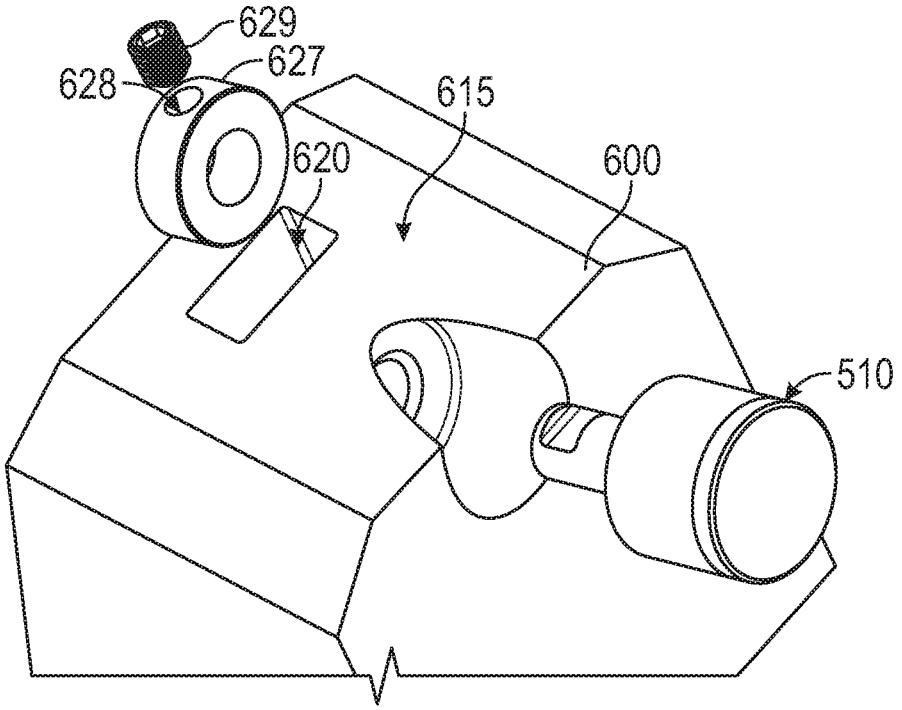
FIG. 11 shows a perspective view of a downhole cutting element support structure including a rolling cutter thereon.
Figure 12:
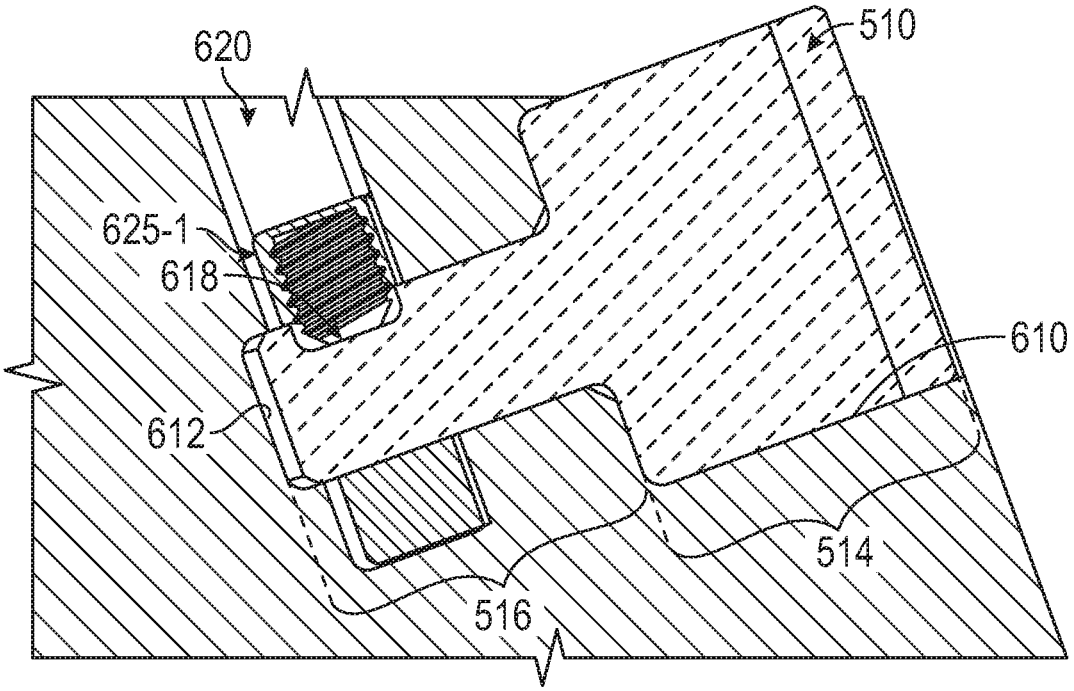
FIG. 12 shows a cross-sectional view of a downhole cutting element support structure including a rolling cutter thereon.

For example, referring now to FIGS. 11-12, an embodiment of a rotatable cutter without a sleeve is shown. As shown in FIGS. 11-12, a rotatable cutting element 510 is disposed in a cutter pocket 610 formed in cutting element support structure 600. A retention opening 620 is spaced rearward of a portion of cutter pocket 610 that extends around the rotatable cutting element by 360 degrees. Further, the cross-sectional view in FIG. 12 shows that cutter pocket 610 includes two diameters, a front diameter proximate the opening of cutter pocket 610 and a second, smaller diameter that is rearward of the point at which the cutter pocket 610 is closed (extends 360 degrees). Retention opening 620 extends from a formation-facing surface 615 of cutting element support structure 600 into structure 600 to intersect with cutter pocket 610 adjacent its back face 612. A retention element 625-1 is disposed in retention opening and interfaces rotatable cutting element 510 around at least a partial circumference of a back retention portion 516 of rotatable cutting element 510. As illustrated, a groove 618 may be formed in back retention portion 516, and retention element 625-1 may be arranged to at least partially fit within such groove 518. In addition to groove 618 formed in back retention portion 516, back retention portion 516 may optionally have a reduced diameter as compared to a cutting portion 514. As illustrated, retention element 625 is a two-piece circumferential lock 627 with a fastener 629 threaded into a hole 628 formed in lock 627. Fastener 629 screws into hole 628 to interface groove 618 formed in rotatable cutting element 510. As illustrated, groove 618 does not need to be circumferential around the entire back retention portion 516, but can instead be a divot or dimple formed therein of a size large enough to fit fastener 629. Rotatable cutting element may be retained by being inserted into cutter pocket 610 and through lock 627. When groove 618 is aligned with hole 628, a fastener may be inserted and fastened therein.

Figure 13:
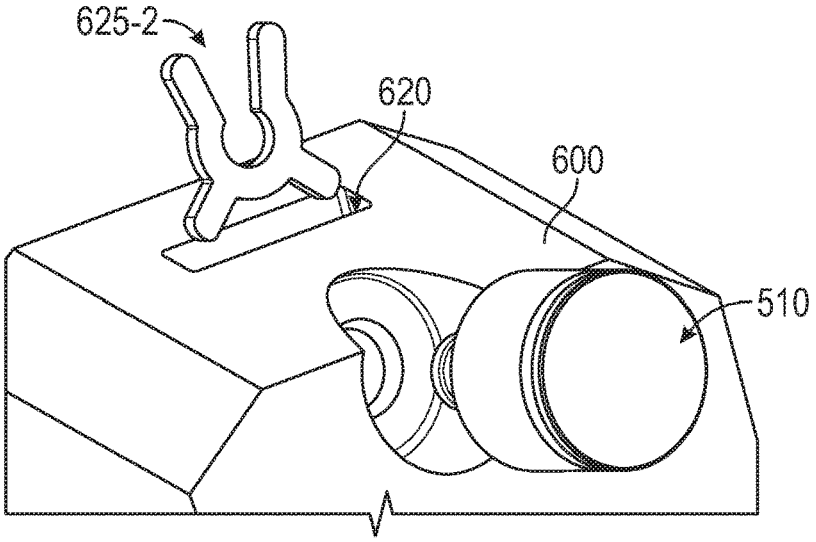
FIG. 13 shows a perspective view of a downhole cutting element support structure including a rolling cutter thereon.
Figure 14:
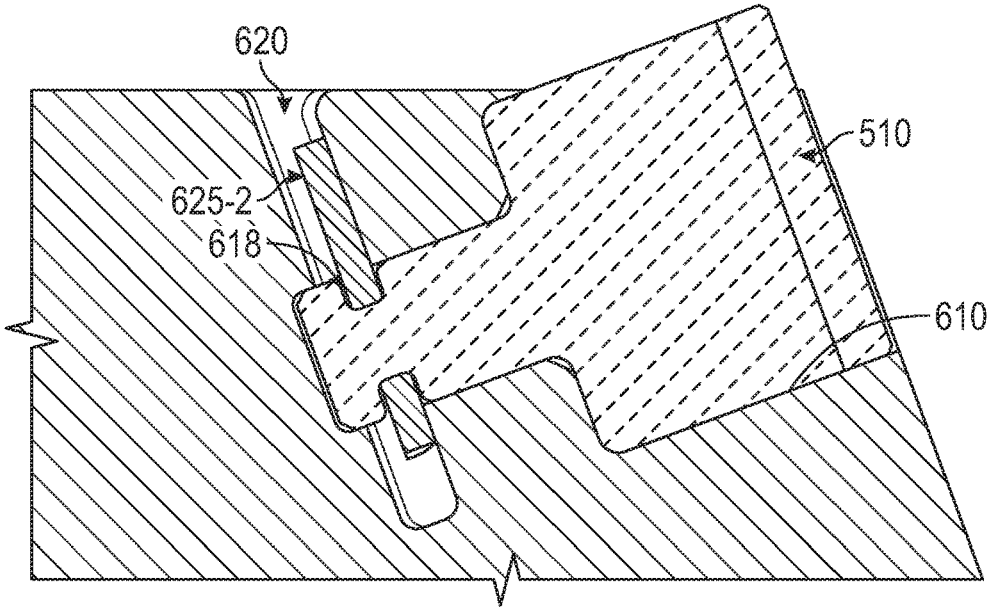
FIG. 14 shows a cross-sectional view of a downhole cutting element support structure including a rolling cutter thereon.
Figure 15:
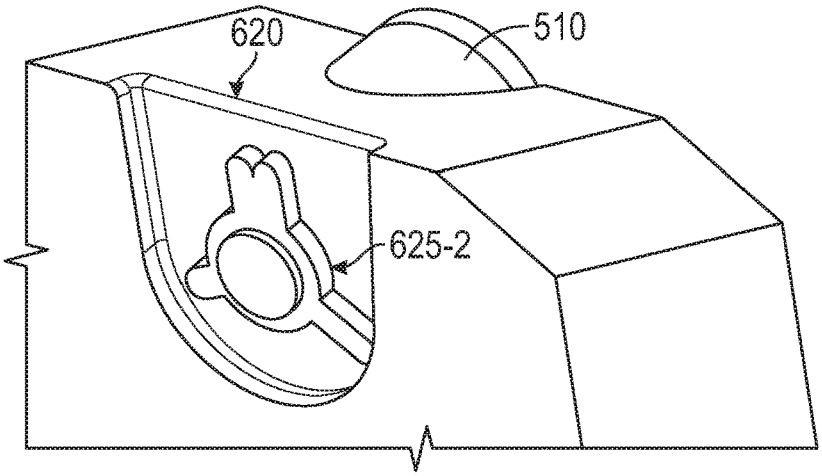
FIG. 15 shows a cross-sectional view of a downhole cutting element support structure including a rolling cutter thereon.
Figure 16:
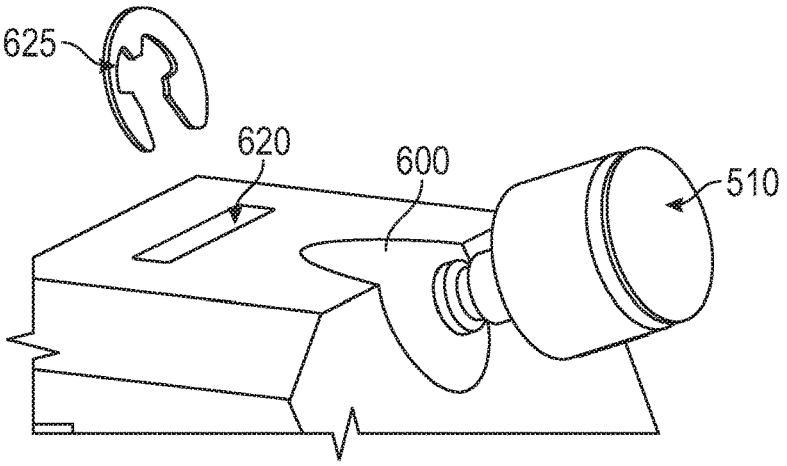
FIG. 16 shows a perspective view of a downhole cutting element support structure including a rolling cutter thereon.
Figure 17:
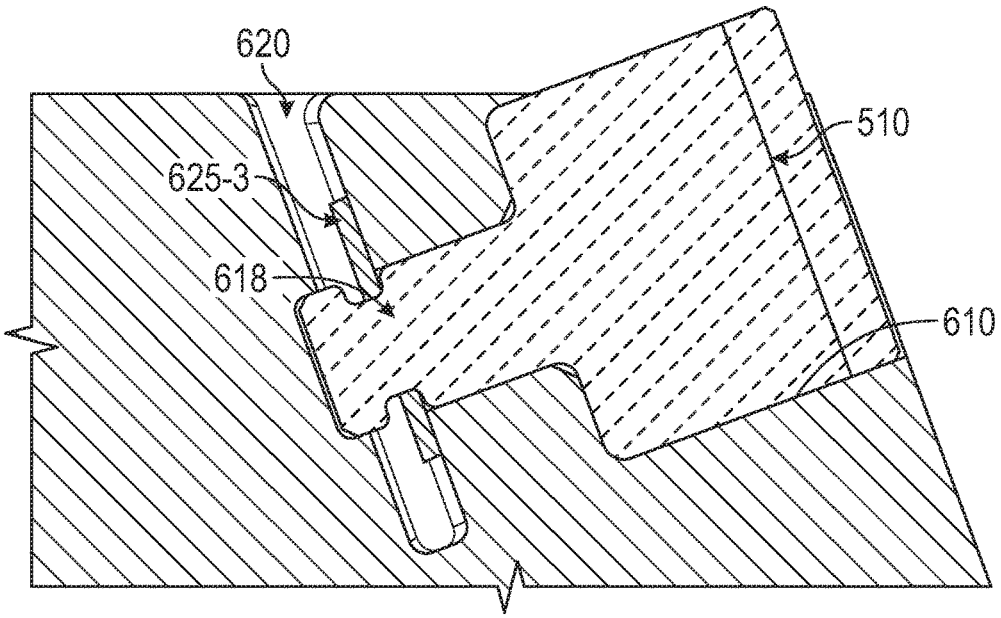
FIG. 17 shows a cross-sectional view of a downhole cutting element support structure including a rolling cutter thereon.
Figure 18:
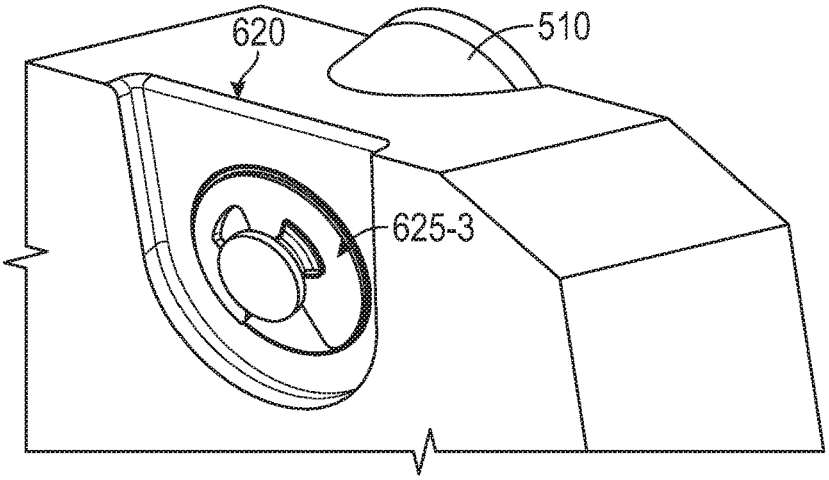
FIG. 18 shows a perspective view of a downhole cutting element support structure including a rolling cutter thereon.

Referring now to FIGS. 13-15 as well as FIGS. 16-18, a rotatable cutting element 510 similar to the one illustrated in FIGS. 11-12 is disposed in a cutter pocket 610 also similar to the one illustrated in FIGS. 11-12, with the exception of retention element 625-2 and 625-3. In the embodiment illustrated in FIGS. 13-15, retention element 625-2 may be a crimp-on retaining clip. Rotatable cutting element may be retained by being inserted into cutter pocket 610 and through the retention element 625-2 (in an un-crimped state). When groove 618 is aligned with retention element 625-2, retention element may be crimped from the retention opening 620. Further, in the embodiment illustrated in FIGS. 16-18, retention element 625-3 is a retaining ring that may extend less than 360 degrees. After rotatable cutting element 510 is disposed in cutter pocket, the retaining ring retention element 625-3 may be inserted into retention opening and fit into groove 618. In one or more particular embodiments, a retaining ring having a conic cross-section may be used, which may aid in pushing rotatable cutting element 510 into the cutter pocket (and provide a spring effect). In the various embodiments illustrated, the retention opening is shown as having a U-shaped cross-section. Such shape may depend, for example, on the type of retention element being used. Further, in one or more embodiments, after retention element retains a rotatable cutting element, the retention opening may be filled with a filler material to reduce drilling fluid from entering the bearing spaces accessible therefrom. In one or more embodiments, the filler may be optionally be removable so that the retention element (and rotatable cutting element) can be removed and replaced.

Figure 21:
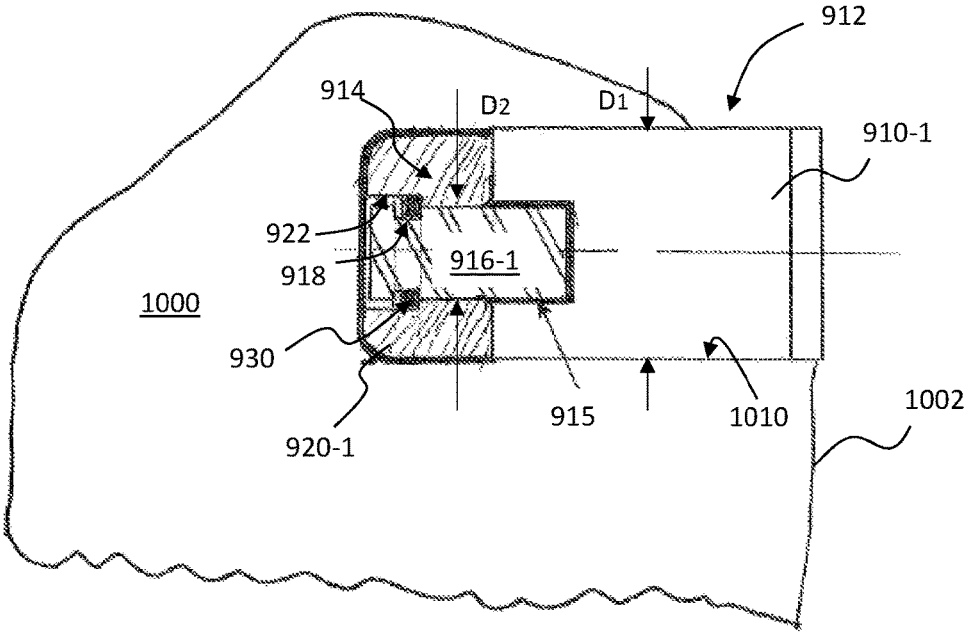
FIG. 21 shows a cross-sectional view of a downhole cutting element support structure including a rolling cutter thereon.

Various embodiments described above (in FIGS. 9-17) may allow for a largest diameter of the inner rotatable cutting element to represent a relatively large amount of the total axial length of the element. For example, such largest diameter may extend at least 40%, 50%, 60%, 70%, or 80% of the axial length of the inner rotatable cutting element. Such longer axial length is also present in the embodiment shown in FIG. 21. As shown in FIG. 21, a rotatable cutting element 910-1 is disposed in a cutter pocket 1010 formed in cutting element support structure 1000. Cutter pocket 1010 opens to the leading face 1002 (in the direction of rotation of the cutting tool). The rotatable cutting element 910-1 includes a cutting end 912 at the full or largest diameter $D_1$ of the rotatable cutting element 910-1, and a retention end 914 at a reduced diameter $D_2$. The retention end 914 at the reduced diameter $D_2$ is formed by a spindle 916-1. As illustrated, spindle 916-1 is a separate component that is brazed and/or threaded into an opening 915 on the component forming the cutting end 912 (having the full diameter $D_1$). While the embodiment illustrates the use of two components, it is also within the scope of the present disclosure that the cutting end 912 and retention end 914 may be integrally formed from a single piece. However, in embodiments using a separate spindle 916-1 component that is attached to the remaining portion of the rotatable cutting element 910-1, use of two components may allow for use of multiple material types to optimize the needs for cutting and retention. Adjacent the back face of the cutting end 912 component of rotatable cutting element 910-1 is a sleeve 920-1, in which the distal end of spindle 916-1 is inserted. A groove 918 is formed in spindle 916-1, which aligns with a corresponding groove 922 in the inner diameter of sleeve 920-1. A retention element 930 is within the grooves 918, 922, thereby retaining the spindle 916-1 of rotatable cutting element 910 within the sleeve. Further, because sleeve 920-1 is also brazed or otherwise affixed or retained within cutter pocket 1010, the retention element 930 also retains the rotatable cutting element 910-1 within cutter pocket.

Figure 22:
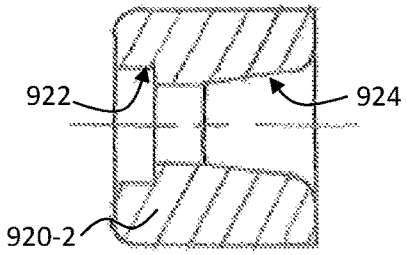
FIG. 22 shows a cross-sectional view of a sleeve.
Figure 24:
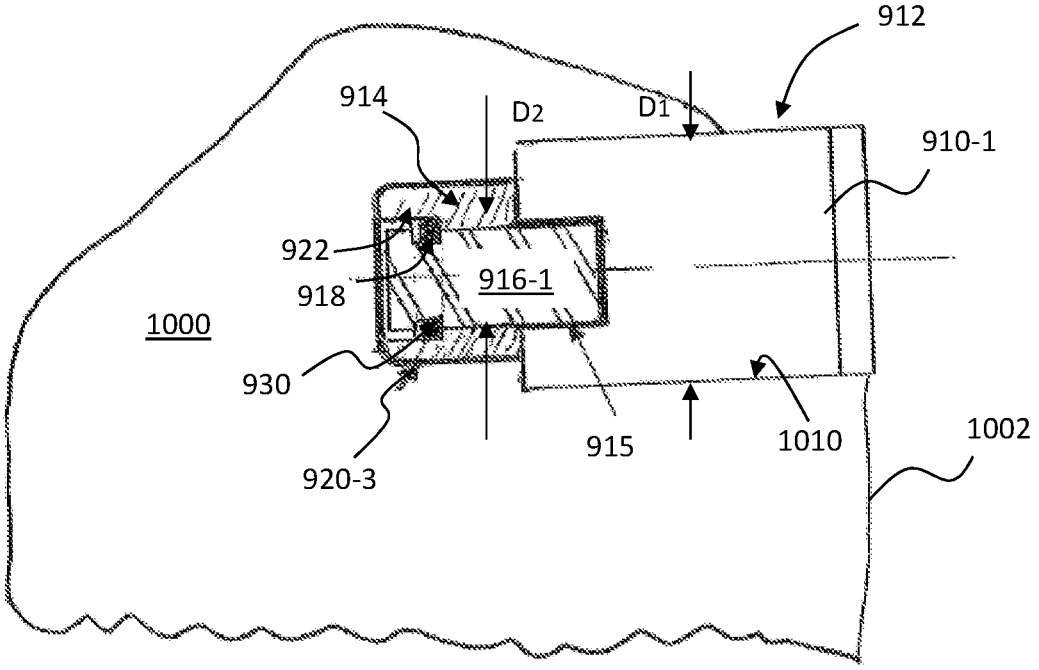
FIG. 24 shows a cross-sectional view of a downhole cutting element support structure including a rolling cutter thereon.

According to some embodiments, $D_1$ extends along at least 40% (or at least 50, or 60%, etc.) of the axial length of rotatable cutting element 910-1, which allows for the longer cutting end 912 having the full $D_1$ be the load bearing surface during rotation, as compared to a reduced diameter spindle portion 916-1. As mentioned, the spindle 916-1 may be formed of a different material, such as a grade of tungsten carbide or a steel that are tougher as compared to the cutting end of rotatable cutting element 910-1. The spindle 916-1 may have a reduced diameter $D_2$ that ranges from 25 to 75% of the full diameter $D_1$ (with embodiments having a lower limit of any of 25, 40, 50% and an upper limit of any of 40, 50, 60, 75%). Depending on the size of the spindle 916-1, the sleeve 920-1 can have the same diameter as $D_1$ or can have a smaller diameter than $D_1$. For example, in FIG. 24, the sleeve 920-3 can have a smaller diameter than $D_1$. Sleeve 920-2 may be modified, as shown in FIG. 22, to have a tapered inner diameter surface 924 at the proximal end thereof, which, in embodiment using a retention ring such as the type described in U.S. Patent Publication No. 2014/0054094, incorporated by reference in its entirety, the tapered inner diameter surface may allow easier installation/compression of the retention ring as a spindle and retention ring are guided into the sleeve 920-2 and groove 922 formed in the sleeve.

Figure 23:
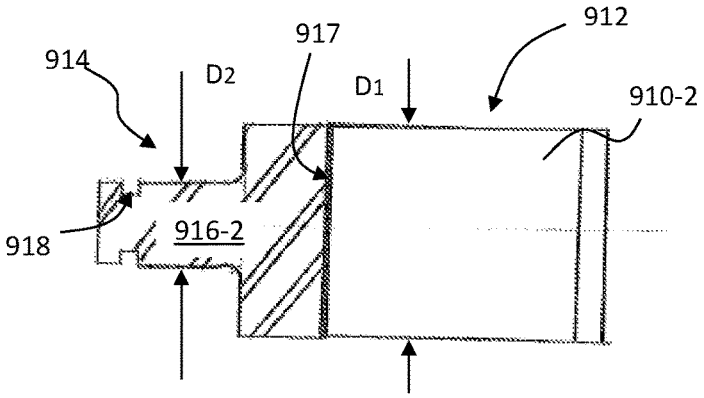
FIG. 23 shows a cross-sectional view of an inner rotatable cutting element.

Further, while FIG. 21 illustrates a spindle being brazed or threaded into an opening formed in the back end of the full diameter $D_1$ portion of rotatable cutting element 910-1, as shown in FIG. 23, a spindle portion 916-2 may be brazed to a planar back end 917 of a rotatable cutting element, without the use of an opening in the back end. As illustrated in FIG. 23, the spindle portion 916-2 may include a proximal end with a full diameter $D_1$ that is brazed to the cutting end 912 and a distal end with a reduced diameter $D_2$ that may be inserted into a sleeve. In some embodiments, the spindle may be integral with the substrate of the rotatable cutting element (e.g., where the spindle is formed at the same time as rest of the cutting element or where a one piece body is formed and the spindle is machined into the retention end of the rotatable cutting element).

One or more embodiments described herein may have an ultrahard material disposed on a substrate. Such ultrahard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by substantially removing metal from the interstitial spaces between interconnected diamond particles or from a diamond/silicon carbide composite, or other ultrahard material such as a cubic boron nitride. Further, in particular embodiments, the rolling cutter may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

Thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are generally found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S.

Pat. Nos. 4,288,248 and 4,104,344. Briefly, a strong acid, such as hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP)diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such as described in U.S. Pat. No. 5,127,923, which is herein incorporated by reference in its entirety.

In one or more other embodiments, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, thermally stable diamond layer may be formed by other methods, including, for example, by altering processing conditions in the formation of the diamond layer.

The substrate on which the cutting face is optionally disposed may be formed of a variety of hard or ultrahard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. Various metal carbide compositions and binders may be used, in addition to tungsten carbide and cobalt. Thus, references to the use of tungsten carbide and cobalt are for illustrative purposes, and no limitation on the type of substrate or binder used is intended. In another embodiment, the substrate may also be formed from a diamond ultrahard material such as polycrystalline diamond or thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be desirable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

The retention element may be formed from a variety of materials. In one embodiment, the retention element may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. It is also within the scope of the present disclosure that the retention element and/or substrate may also include one or more lubricious materials, such as diamond to reduce the coefficient of friction therebetween. The components may be formed of such materials in their entirely or portions of the components may include such lubricious materials deposited on the component, such as by chemical plating, chemical vapor deposition (CVD) including hollow cathode plasma enhanced CVD, physical vapor deposition, vacuum deposition, arc processes, or high velocity sprays. In a particular embodiment, a diamond-like coating may be deposited through CVD or hallow cathode plasma enhanced CVD, such as the type of coatings disclosed in US 2010/0108403, which is assigned to the present assignee and herein incorporated by reference in its entirety.

In other embodiments, the retention elements may be formed of tool steel or other alloy steels, nickel-based alloys, or cobalt-based alloys. One or more components may be coated with a hardfacing material for increased erosion protection. Such coatings may be applied by various techniques known in the art such as, for example, detonation gun (d-gun) or spray-and-fuse techniques.

The cutting elements of the present disclosure may be incorporated in various types of cutting tools, including for example, fixed cutter bits or hole enlargement tools such as reamers. Bits having the cutting elements of the present disclosure may include a single rolling cutter with the remaining cutting elements being conventional fixed cutting elements, all cutting elements being rotatable, or any combination therebetween of rolling cutters and conventional, fixed cutters. Further, cutting elements of the present disclosure may be disposed on cutting tool blades (such as drag bit blades or reamer blades) having other wear elements incorporated therein. For example, cutting elements of the present disclosure may be disposed on diamond impregnated blades. Additionally, any size cutting elements may be used. For example, in various embodiments, the cutting elements may be formed in sizes including, but not limited to, 9 mm, 11 mm, 13 mm, 16 mm, and 19 mm.

Further, any of the design modifications as described above, including, for example, side rake, back rake, variations in geometry, surface alteration/etching, seals, bearings, material compositions, diamond or similar low-friction bearing surfaces, etc., may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

Figure 19:
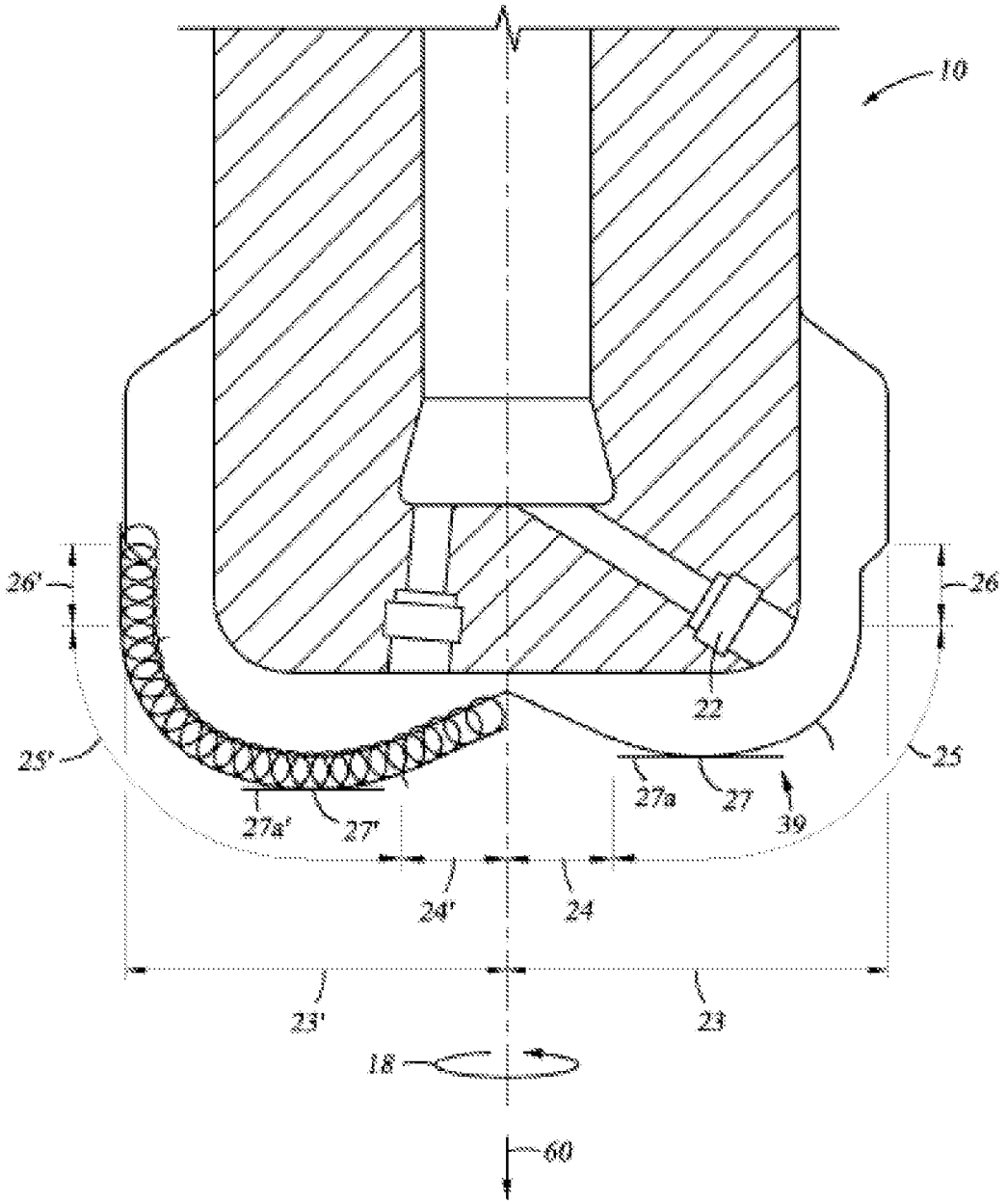
FIG. 19 shows a rotated profile view of a drill bit.

In one or more embodiments, rolling cutters may be disposed in locations of the bit or other tool experiencing the greatest wear, such as the nose or shoulder of the bit. Referring now to FIG. 19, a profile of bit 10 is shown as it would appear with all blades and cutting faces of all cutting elements (including both fixed cutters such as those referenced as 150 in FIG. 1 and rolling cutters such as those referenced as 300 in FIG. 3) rotated into a single rotated profile when rotated 18 about axis 60. In rotated profile view, blade tops of all blades of bit form and define a combined or composite blade profile 39 that extends radially from bit axis 60 to outer radius 23 of bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view).

Composite blade profile 39 (most clearly shown in the right half of bit 10 in FIG. 19) may generally be divided into three regions conventionally labeled cone region 24, shoulder region 25, and gage region 26. Cone region 24 includes the radially innermost region of bit 10 and composite blade profile 39 extending generally from bit axis 60 to shoulder region 25. As shown in FIG. 19, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 60 at the outer radial periphery of composite blade profile 39. Thus, composite blade profile 39 of bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes only one convex shoulder region (e.g., convex shoulder region 25), and only one blade profile nose (e.g., nose 27). In one or more embodiments, rolling cutters of the present disclosure may be located in the nose and/or shoulder region of the cutting profile, and fixed cutters may be located in the cone and/or gage of the cutting profile. In other embodiments, the rolling cutters may also be disposed in the cone and/or gage of the cutting profile. For example, in one or more embodiments, rolling cutters 300 are located in at least some of the nose and shoulder regions of the blades, while fixed cutters 150 are located in the cone and gage regions of the blade. It is also within the scope of the present disclosure that the nose and shoulder may also include fixed cutters as either primary or back-up cutting elements.

Figure 20:
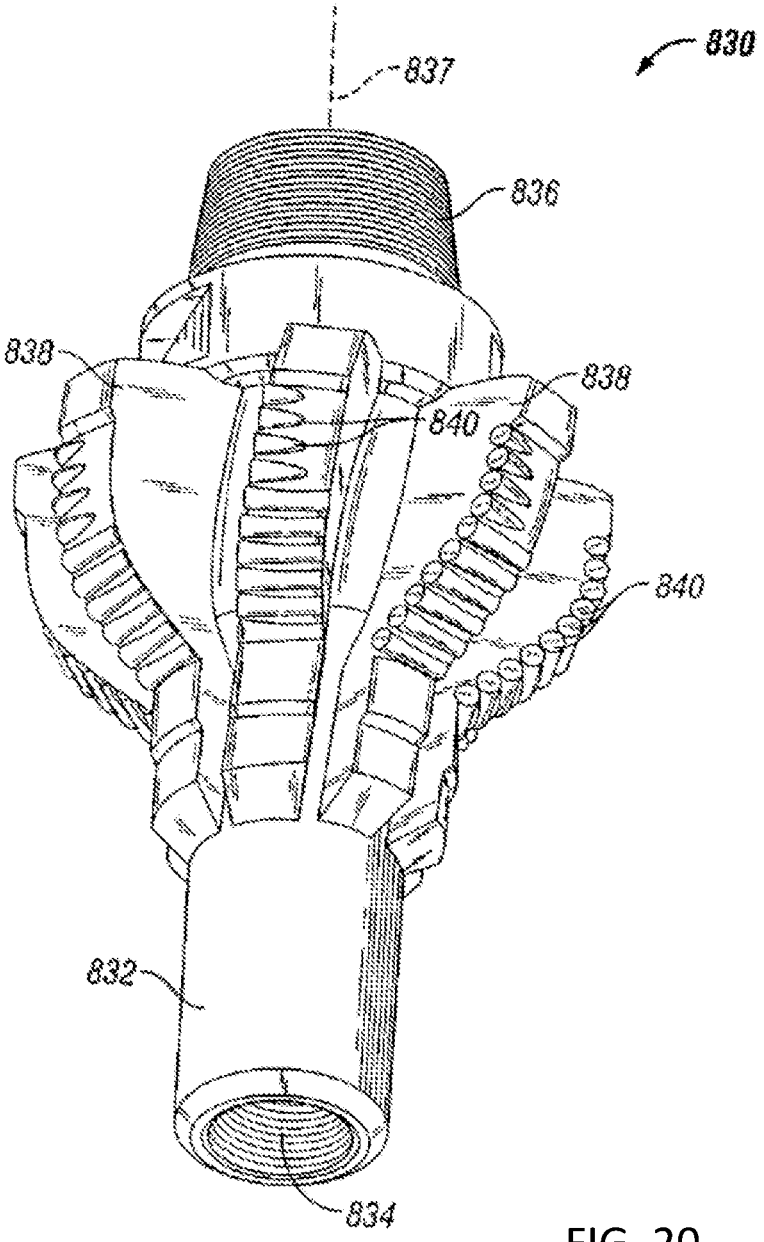
FIG. 20 shows a tool that may use the cutting elements of the present disclosure.

As described throughout the present disclosure, the cutting elements may be used on any downhole cutting tool, including, for example, a fixed cutter drill bit or hole opener. FIG. 20 shows a general configuration of a hole opener 830 that includes one or more cutting elements of the present disclosure. The hole opener 830 includes a tool body 832, a plurality of blades 838 disposed at selected azimuthal locations about a circumference thereof, and a plurality of cutting elements 840 on the blades 838. The hole opener 830 generally includes connections 834, 836 (e.g., threaded connections) so that the hole opener 830 may be coupled to adjacent drilling tools that include, for example, a drillstring and/or bottom hole assembly (BHA) (not shown). The tool body 832 generally includes a bore therethrough (along axis 837) so that drilling fluid may flow through the hole opener 830 as it is pumped from the surface (e.g., from surface mud pumps (not shown)) to a bottom of the wellbore (not shown). The tool body 832 may be formed from steel or from other materials. For example, the tool body 832 may also be formed from a matrix material infiltrated with a binder alloy. The blades 838 shown in FIG. 20 are spiral blades and are generally positioned at substantially equal angular intervals about the perimeter of the tool body. This arrangement is not a limitation on the scope of the disclosure, but rather is used merely to illustrative purposes. Any downhole cutting tool may be used. While FIG. 20 does not detail the location of the rolling cutters, their placement on the tool may be according to any of the variations described above.

Although just a few embodiments have been described in detail above, those skilled in the art will appreciate that many modifications are possible in the example embodiments without materially departing from the apparatus, systems, and methods disclosed herein. Accordingly, such modifications are intended to be included within the scope of this disclosure. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function for any limitations of any of the claims herein, except for those in which the claim expressly uses the words 'means for' together with an associated function. Each addition, deletion, and modification to the embodiments that fall within the meaning and scope of the claims is to be embraced by the claims.

What is claimed:

1. A downhole cutting tool, comprising:

a tool body defining a cutter pocket and a retention opening positioned rotationally behind the cutter pocket; and a rolling cutter in the cutter pocket, the rolling cutter comprising an inner rotatable cutting element and a sleeve, the inner rotatable cutting element being partially within the sleeve and having a retention portion outside of the sleeve, the retention portion comprising a groove in an outer circumference of the inner rotatable cutting element, wherein the axial movement of the inner rotatable cutting element being limited by an external retention element that couples to the retention portion of the inner rotatable coupling element, and is positioned in the groove inside the retention opening and outside of the sleeve;

wherein the rolling cutter further comprises an internal retention element interfacing between the sleeve and the inner rotatable cutting element.

2. The downhole cutting tool of claim 1, wherein the external retention element is a c-clamp.

3. The downhole cutting tool of claim 1, wherein a cutting extension portion of the inner rotatable cutting element is opposite the retention portion, extends axially beyond the sleeve, and is at least partially supported by the cutter pocket.

4. The downhole cutting tool of claim 1, wherein the downhole cutting tool is a fixed cutter bit comprising a bit body and a plurality of blades extending from the bit body, wherein the cutter pocket is in one of the plurality of blades.

5. The downhole cutting tool of claim 4, wherein the rolling cutter is on a nose area or a shoulder area of at least one of the plurality of blades.

6. A downhole cutting tool, comprising:

a tool body defining a cutter pocket; and a rolling cutter in the cutter pocket, the rolling cutter comprising an inner rotatable cutting element partially in a circumferential sleeve, the inner rotatable cutting element having a back retention portion that extends axially beyond a formation facing portion of the the circumferential sleeve, the back retention portion having a groove, and a retention element in the groove, wherein a bottom end of the circumferential sleeve axially overlaps the retention element wherein the rolling cutter comprises an internal retention element that is a retaining ring in corresponding grooves in the inner rotatable cutting element and the circumferential sleeve.

7. The downhole cutting tool of claim 6, wherein a cutting extension portion of the inner rotatable cutting element extends axially beyond the circumferential sleeve and is at least partially supported by the cutter pocket.

8. A downhole cutting tool, comprising:

a tool body having a cutting element support structure, the cutting element support structure comprising:

a cutter pocket in the at least one cutting element support structure and extending from an opening in a leading face and formation facing surface of the cutting element support structure;

at least one retention opening formed in the formation facing surface spaced rearward from the opening of the cutter pocket, the at least one retention opening extending into the cutter pocket to interface the back of the cutter pocket; and a rolling cutter in the cutter pocket, the rolling cutter at least partially retained in the pocket by a retention element in the at least one retention opening.

9. The downhole cutting tool of claim 8, wherein the rolling cutter comprises a sleeve and an inner rotatable element, at least a portion of the rolling cutter being in the sleeve.

10. The downhole cutting tool of claim 8, wherein the rolling cutter comprises a retention portion having a reduced diameter proximate a back face of the rolling cutter as compared to a diameter proximate an exposed cutting surface of the rolling cutter.

11. The downhole cutting tool of claim 10, wherein the retention portion of the rolling cutter has a groove in the reduced diameter portion, and wherein the retention element interfaces the rolling cutter at the groove.

12. The downhole cutting tool of claim 8, wherein the cutter pocket has a larger cross-sectional area proximate the leading face as compared to proximate the back face and the at least one retention opening.

13. The downhole cutting tool of claim 8, the rolling cutter comprising an inner rotatable cutting element, the inner rotatable cutting element having a outermost diameter that extends at least 40% of an axial length of the inner rotatable cutting element, the inner rotatable cutting element further having a groove formed therein.

14. The downhole tool of claim 13, wherein the rolling cutter further comprises a sleeve in which a portion of the rotatable cutting element is located.

15. The downhole tool of claim 14, wherein the outermost diameter of the rotatable cutting element is at least the outer diameter of the sleeve.

16. The downhole tool of claim 14, wherein the rotatable cutting element comprises a spindle that extends from a back end thereof into the sleeve.

17. The downhole tool of claim 16, wherein the spindle is brazed or threadedly attached to a cutting end portion of the rotatable cutting element.

* * * * *